US005361575A

United States Patent [19]

Rozenwasser

[11] Patent Number: 5,361,575

[45] Date of Patent: Nov. 8, 1994

[54] FINE JEWELRY ROPE CHAIN

[75] Inventor: David Rozenwasser, Savion, Israel

[73] Assignee: David Rozenvasser, Ltd., Petach, Israel

[21] Appl. No.: 29,032

[22] Filed: Mar. 10, 1993

[30] Foreign Application Priority Data

Feb. 21, 1993 [IL] Israel ..... 104811

[51] Int. Cl.[5] ..... B21L 5/02

[52] U.S. Cl. ..... 59/80; 59/3; 59/83

[58] Field of Search ..... 59/1, 3, 80, 83

[56] References Cited

U.S. PATENT DOCUMENTS 4,651,517 3/1987 Benhamou ..... 59/80
4,934,135 6/1990 Rozenwasser ..... 59/80
4,996,835 3/1991 Rozenwasser ..... 59/80
5,185,995 2/1993 Dal Monte ..... 59/83

*Primary Examiner*—David Jones
*Attorney, Agent, or Firm*—Helfgott & Karas

[57] ABSTRACT

A jewelry rope chain having tightly interfitting links made of wire of a given cross-section, each link having a small gap formed therein, so as to enable one of said links to pass through the gap of a second link, said links being intertwined to fit tightly one against the other and form in-outward appearance a double helix, the improvement comprising each link having a wire cross-section including a major axis defining a longer dimension and a minor axis defining a shorter dimension, said longer dimension being in the plane of the link and the shorter dimension being perpendicular thereto, the ratio of said longer dimension to said shorter dimension being greater than 1.3:1 but less than 3:1.

4 Claims, 2 Drawing Sheets

PPIOR ART

FINE JEWELRY ROPE CHAIN

FIELD OF THE INVENTION

The present invention relates to novel jewelry chains specifically of the type known as rope chains and to a method for making same.

BACKGROUND OF THE INVENTION

Rope chains made from precious metal have for decades been made largely by hand. The basic construction element or component of such rope chains is a ring or link formed from a solid or hollow wire of precious metal, e.g. 14 karat gold. Such a ring 1 is shown in FIG. 1 and has an opening or gap (g) formed therein This gap g has a narrow dimension 2 at its inner diameter and a wider dimension at its outer diameter. The narrow dimension 2 of the gap g is slightly larger than the cross-section of the wire forming the ring 1, so that one ring can be inserted through the gap of another ring.

A multiplicity of such rings I are intertwined to form, in outward appearance, a double helix as shown in FIG. 2, which is the format of a standard rope chain. These tightly interfitting ring rope chains are generally hand made. However, machines have been developed to make rope chains, but these machine made chains generally have an inferior appearance than the hand made ones.

The wire forming the ring (FIG. 3) has a generally circular cross-section with slightly flattened sides 4 and rounded ends 5 which give the ring 1 a major dimension 6 and a minor dimension 7. The gap g of ring 1 is substantially larger than the minor dimension 7 and slightly larger at its narrowest dimension 2 than the major dimension 6, so that one ring can fit into another ring through the gap at any angle.

The reason for the slightly flattened sides 4 of the cross-section of the ring wire is a result of the process for making the round wire links and comes about as follows. The precious metal wire, generally having a circular cross-section, is wound around a mandrel to form a spiral coil. The coil is then cut so that each loop is cut slightly askew of its adjacent loop, resulting in accentric wire links having gaps accentrically aligned. In order to straighten these accentric links to be planar, the links are passed between pressure rollers or other pressure means to force the gap ends into the same plane. This pressure exerted on the planar surface of the rings causes a slight flattening of the cross-section of the ring wire. For all intents and purposes, this slight flattening is insignificant and results in a ring wire cross-section having major 6 and minor 7 dimensions a ratio of 1.1:1 to about 1.2:1. In the making of rope chains, such slightly flattened rings were treated as substantially being of round cross-section.

For the longest time these rope chains were made from split annular rings having approximately a 3:1 ratio of ring inner diameter to major wire dimension. Benhamou, U.S. Pat. No. 4,651,517, discovered that it is possible to substantially reduce the amount of precious metal required to make a rope chain of equivalent width and length by using a thinner wire annular ring and changing the ratio of ring inner diameter to major wire dimension to just over X times greater than the major wire dimension, where X is an odd number greater than three. In effect, by having the ratio of ring inner diameter to major wire dimension of approximately 5:1, 7;1 etc., one obtains according to this patent rope chains of similar diameter and length as the 3:1 ratio rope chain with significant reduction of weight.

A further improvement in weight saving in the manufacture of rope chains was claimed in my earlier patent, U.S. Pat. No. 4,996,835. In this patent, I disclose that substantial further weight saving can be obtained in the making of rope chains by using non-circular elongated shaped rings having a major axis defining longer outer and inner diameters and a minor axis defining shorter outer and inner diameters, and wherein the gap lies in a link section parallel to the major axis, and the shorter inner diameter being just over X times greater than the cross-section of the link wire, where X is a number equal to or greater than two, and the links are positioned in the chain so that the longer outer diameter defines the width of a chain.

To briefly summarize the development in improved rope chains, we can say that lighter rope chains, i.e. less weight of gold, having the same outer dimensions and appearance than the classical 3:1 ratio round link rope chains, can be obtained by either enlarging the inner ring diameter and introducing into the inner diameter more but thinner links (U.S. Pat. No. 4,651,517) or by changing the configuration of the chain link from a round configuration to an elongated configuration with the longer dimension providing the outer diameter of the chain. Both of the above described improvements have deviated from the classical rope chains made from round rings having apprxoimately a 3:1 ratio of inner ring diameter to wire cross-section diameter.

It is the object of the present invention to provide a precious metal rope chain with substantial weight saving.

Another object of the invention is to provide such a weight saving with a rope chain using classical round rings having a 3:1 ratio of inner ring diameter to major wire cross-section dimension.

It is a further object of the invention to provide improved weight saving in fine jewelry rope chains made with links having any shape whether round, elongated or polygonal.

Yet a further object of the invention is to provide fine jewelry rope chains having a silkier appearance than corresponding chains, whether these chains are made from round classical links with a 3:1 ratio or the Benhamou links with a ratio of 5:1 or 7:1 or the elongated links of my previously mentioned patent.

In accordance with this invention, there is provided a jewelry rope chain having tightly interfitting links made of wire of a given cross-section, each link having a small gap formed therein, so as to enable one of said links to pass through the gap of a second link, said links being intertwined to fit tightly one against the other and form in outward appearance a double helix, the improvement comprising each link having a wire cross-section including a major axis defining a longer dimension and a minor axis defining a shorter dimension, said longer dimension being in the plane of the link and the shorter dimension being perpendicular thereto, the ratio of said longer dimension to said shorter dimension being greater 1.3:1 but less than 3:1.

In a preferred embodiment, the gap of the link is narrower than the longer dimension of the wire cross-section.

The specific shape of the cross-section of the link wire is unimportant as long as the ratio of longer to shorter dimensions is maintained. Thus, the shape may be rectangular, rectangular with rounded edges, diamond shaped with rounded edges on the longer diameter, round with flattened sides, oval or elliptical, elongated hexagonal or octagonal etc.

Since the planar configuration of the links in accordance with this invention have the same configuration as corresponding conventional links, they can be used in the same manner as their corresponding conventional links in the preparation of rope chains. However, because the links in accordance with this invention are thinner, the gap in the links should be smaller than the large dimension of the wire cross-section and preferably only slightly larger than the shorter dimension of the wire cross-section. This gap size is important, since a larger gap will generally result in a loose chain with too much twist to it.

The discovery of this invention is remarkable and quite surprising, particularly since wire links having slightly flattened cross-sections have been known in the art for so many years. The significant advantage obtained by increasing the ratio of the major to minor dimensions of the wire cross-section to greater than 1.3:1 was totally unappreciated. This is evident from U.S. Pat. No. 4,651,517 which in order to achieve a reduction in weight for the rope chain, found it necessary to depart from the classical 3:1 ratio to a higher ratio of 5:1, 7:1 etc., while at the same time reducing the entire cross-section of the wire links. According to the present invention, a rope chain made with links having a wire cross-section as defined, even with links having a 3:1 ratio, provide significant weight saving over the rope chains made with conventional cross-section wire links, even over chains made according to U.S. Pat. No. 4,651,517 with links having a ratio of inner link dimension to wire cross-section of 5:1.

Figure 1:
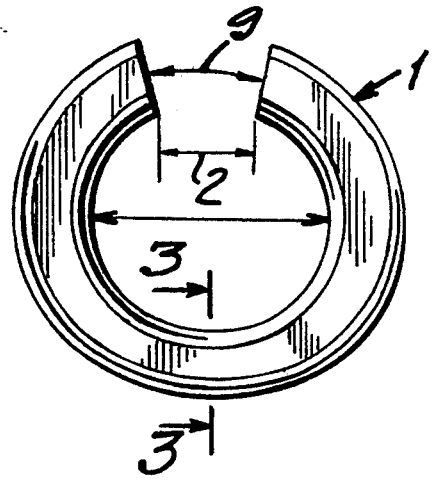
PRIOR ART FIG.1
FIG. 1 is a plan view of a classical chain link used for making rope chains.
Figure 2:
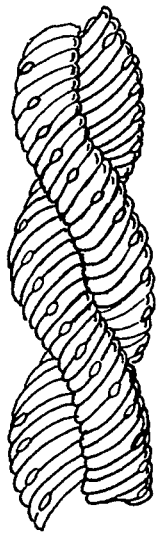
PRIOR ART FIG.2
FIG. 2 is a side elevation showing a section of rope chain.
Figure 3:
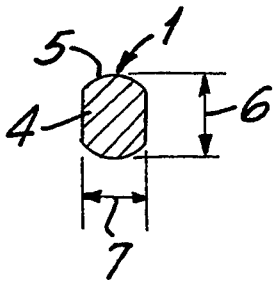
PRIOR ART FIG.3
FIG. 3 is a cross-section of conventional link wire.
Figure 4:
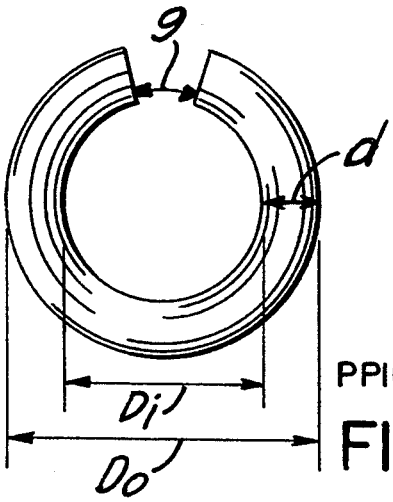
FIG. 4 is a plan view of a classical chain link having a round wire diameter.
Figure 5:
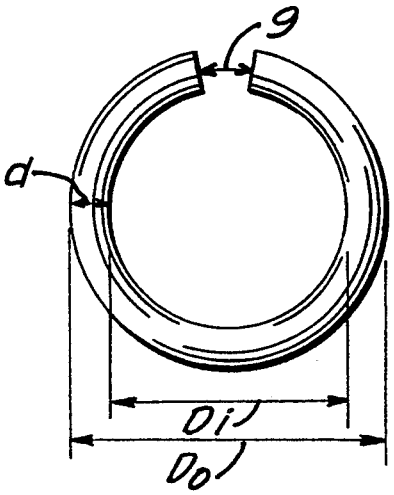
PRIOR ART FIG.5
FIG. 5 is a plan view of a chain link used for making a rope chain in accordance with U.S. Pat. No. 4,651,517 having a round wire diameter.

Table 1 summarizes approximate calculated data for rope chains made from links of FIGS. 4 to 8. This data illustrates the significant advantages obtained in accordance with the present invention, both as to weight saving and assembly time compared with the prior art. The data of Table 1 is only approximate for purposes of demonstrating the general principle and was calculated as follows:

With respect to FIGS. 4 and 5:

Volume of link ($V_1$) = Volume of link ($V_r$) − Volume of gap ($V_g$).

$$V_1 = V_r - V_g$$

$$V = \pi r^2 h;\ h = \pi . D_o,$$

where $D_o$ is the outer link diameter and g is the gap $$V_1 = \pi r^2 . \pi D_o - \pi r^2 g$$

$$V_1 = \pi r^2 (\pi D_o - g)$$

Figure 4A:
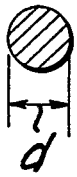
FIGS. 4*a* and 4*a* show the cross-sections of the wires of FIG. 4.

For FIG. 4*a* $V_1 = 16.36\ m^2 - 1.08\ m^2 = 15.28\ m^2$.
For FIG. 5*a* $V_1 = 9.15\ m^2 - 0.47\ m^2 = 8.68\ m^2$.

Figure 6:
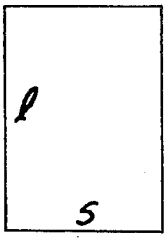
FIGS. 6 to 12 are cross-sections of wires of chain links for rope chains in accordance with this invention having plan views as in FIG. 4.
Figure 7:
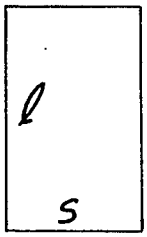
Figure 8:
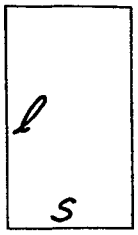

With respect to FIGS. 6–8:

$$V_1 = d_1 . d_s . \pi D_o - d_1 . d_s g,$$

$$V_1 = d_1 . d_s (D_o - g).$$

Figure 9:
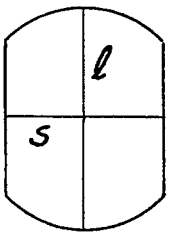
Figure 10:
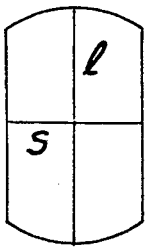
Figure 11:
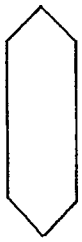
Figure 12:
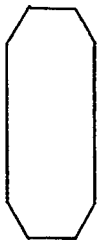

For FIGS. 9 and 10, the volumes of the links were calculated to be 91.1% and 94.26% of FIGS. 6 and 7 respectively.

It is thus quite apparent that flattening the wire cross-section of a link so that the ratio of the cross-section dimensions is 1.4:1 (FIG. 9) produces a lighter weight rope chain than that produced by the method of U.S. Pat. No. 4,651,517 (FIG. 5), even when the ratio of the inner diameter of the link to the longer dimension of the wire cross-section is slightly above three. This weight saving in a rope chain is obtainable using any kind of chain link, whether it be round or elongated and irrespective of the ratio of the inner link diameter to wire cross-section when the wire cross-section ratio is as defined according to this invention.

From a practical point of view of course, there is a limit to how thin the chain links can be made and yet produce acceptable jewelry rope chains. If the links are too thin, i.e. the ratio of the longer to shorter dimension of the wire cross-section is greater than 2.8:1, the appearance will no longer be that of a conventional rope chain, but rather a double helix chain with links having substantial angles separating one from the other. Thus, a preferred ratio of longer to shorter wire dimensions for making jewelry chains in accordance with this invention is between 1.3:1 and 2.8:1. A more preferred ratio is 1.5:1 to 2.3:1 and most preferred is the ratio of 1.7:1 to 2:1.

Another advantageous feature of the present invention is that by using thinner links, as for example in FIGS. 9 and 10, having ratios of longer to shorter wire cross-section dimension of 1.4:1 and 1.65:1 respectively, the rope chain has a silkier look than the conventional chain made in accordance with FIG. 4 due to the fact that the crests of the links are narrower, giving the chain a silkier look.

The flattened planar surface of the links provides in addition to weight saving, a brighter luster to the chain approaching diamond cut facets because of the large flat reflecting surfaces.

The links for use in this invention can be hollow or semi-hollow as is known in the art.

TABLE 1

Figure 5A:
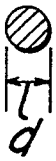
FIGS. 5*a* and 5*a'* are the cross-section of the wire of FIG. 5.
Figure 4A:
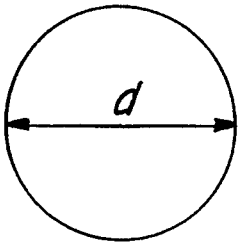
Figure 5A:
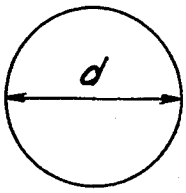

| | FIG. 4a | FIG. 5a | FIG. 6 | FIG. 7 | FIG. 8 | FIG. 9 | FIG. 10 |
|---|---|---|---|---|---|---|---|
| $D_o$ | 5.8 | 5.8 | 5.8 | 5.8 | 5.8 | 5.8 | 5.8 |

TABLE 1-continued

| | FIG. 4a | FIG. 5a | FIG. 6 | FIG. 7 | FIG. 8 | FIG. 9 | FIG. 10 |
|---|---|---|---|---|---|---|---|
| $D_i$ | 3.66 | 4.2 | 3.66 | 3.66 | 3.66 | 3.66 | 3.66 |
| $d_w$ | 1.07 | 0.8 | — | — | — | — | — |
| $d_l$ | — | — | 1.07 | 1.07 | 1.07 | 1.07 | 1.07 |
| $d_s$ | — | — | 0.76 | 0.65 | 0.61 | 0.76 | 0.65 |
| $d_l/d_s$ | 1 | 1 | 1.4 | 1.65 | 1.75 | 1.4 | 1.65 |
| $\pi_w = \left(\frac{d}{2}\right)$ | 0.535 | 0.4 | — | — | — | — | — |
| g | 1.2 | 0.9 | 0.85 | 0.8 | 0.75 | 0.85 | 0.8 |
| $V_L$ | 15.29 $mm^3$ | 8.7 $mm^3$ | 14.3 $mm^3$ | 12.11 $mm^3$ | 11.4 $mm^3$ | 13.03 $mm^3$ | 11.41 $mm^3$ |
| L/m | 690 | 1034 | 690 | 690 | 690 | 690 | 690 |
| V/m | 10550 | 8996 | 9867 | 8356 | 7866 | 8989 | 7876 |
| S | — | 14.73% | 6.47% | 20.8% | 25.4% | 14.8% | 25.3% |

$D_o$ = outside diameter of link
$D_i$ = inside diameter of link
$d_w$ = diameter of wire cross-section
$d_l$ = long diameter of wire
$d_s$ = short diameter of wire
$\pi_w$ = radius of wire cross-section
g = gap
$V_L$ = volume of link
L/m = number of links per meter
V/m = volume of links per meter
S = saving in percent with respect to FIG. 4a

I claim:

1. A jewelry rope chain having tightly interfitting links made of wire of a given cross-section, each link having a small gap formed therein, so as to enable one of said links to pass through the gap of a second link, said links being intertwined to fit tightly one against the other and form in outward appearance a double helix, the improvement comprising each link having a wire cross-section including a major axis defining a longer dimension and a minor axis defining a shorter dimension, said longer dimension being in the plane of the link and the shorter dimension being perpendicular thereto, the ratio of said longer dimension to said shorter dimension being greater than 1.3:1 but less than 3.1, and wherein the gaps of the chain links are narrower than the longer dimension of the wire cross-section of said links.

2. A rope chain as in claim 1, wherein the ratio of longer dimension of the wire cross-section to shorter dimension of the wire cross-section is between 1.3:1 and 2.3:1.

3. A rope chain as in claim 1, wherein the ratio of longer dimension of the wire cross-section to shorter dimension of the wire cross-section is greater than 1.4:1 to 2:1.

4. A rope chain as in claim 1, wherein the ratio of the inner link diameter is just over X times greater than the longer dimension of the cross-section of the link wire and where x is a number equal to or greater than 2.

* * * * *